US007303246B2

(12) United States Patent
Buonerba et al.

(10) Patent No.: US 7,303,246 B2
(45) Date of Patent: Dec. 4, 2007

(54) PRINTHEAD-TO-MEDIA SPACING ADJUSTMENT APPARATUS AND METHOD

(75) Inventors: Kale Mark Buonerba, Singapore (SG); Wai Yuen Ho, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 277 days.

(21) Appl. No.: 11/016,301

(22) Filed: Dec. 16, 2004

(65) Prior Publication Data

US 2006/0132515 A1 Jun. 22, 2006

(51) Int. Cl.
*B41J 25/308* (2006.01)

(52) U.S. Cl. ..... 347/8; 347/5; 347/12

(58) Field of Classification Search ..... 347/8, 347/9, 19, 5, 12; 400/56
See application file for complete search history.

(56) References Cited

U.S. PATENT DOCUMENTS 4,990,004 A * 2/1991 Kawahara et al. ..... 400/56
5,414,453 A 5/1995 Rhoads et al.
6,616,354 B2 9/2003 O'Hara et al.
6,666,537 B1 12/2003 Kelley et al.
6,672,696 B2 1/2004 Fairchild et al.
2003/0039499 A1* 2/2003 Kelley et al. ..... 400/56
2003/0107610 A1* 6/2003 Lim ..... 347/8

* cited by examiner

*Primary Examiner*—Lam Son Nguyen

(57) ABSTRACT

An apparatus for adjusting the printhead-to-media spacing in an inkjet printer is disclosed. The apparatus includes a carriage rod that is fixed in position relative to a media support and a carriage for supporting at least one printhead. The carriage has a contact surface that abuts the carriage rod to allow the carriage to be supported thereon and moveable laterally along the length of the carriage rod. The apparatus further includes an actuating means that moves the carriage relative to the carriage rod along an axis transverse to a longitudinal axis of the carriage rod. During the movement, the contact surface of the carriage remains in abutment with the carriage rod to thereby allow the carriage to continue to be supported on the carriage rod. A method of printhead-to-media spacing adjustment, implementable using the apparatus, is also disclosed.

1 Claim, 7 Drawing Sheets

PRINTHEAD-TO-MEDIA SPACING ADJUSTMENT APPARATUS AND METHOD

BACKGROUND

This invention relates generally to a printer, and in particular to an apparatus and a method in an inkjet printer for adjusting the printhead-to-media spacing to accommodate different thicknesses of print media.

In a typical printer, such as an inkjet printer, the default printhead-to-media spacing is typically set to accommodate a commonly used, single-sheet-thickness, bond-weight paper, such as 20-lb. bond-weight paper. Envelopes and other print media are usually substantially thicker than a single sheet of such paper, and because of this, it is desirable to enable printhead-to-media spacing to be adjusted, either via user selection, or via automatic media thickness sensing, or both, so as to accommodate such thicker media.

To accomplish this kind of adjustment in the past, various approaches have been made to effect changes in such spacing. Typically, the carriage which supports the printheads is itself supported on two spaced structures, one of which is called a carriage rod, and the other of which is called an anti-rotation rail. The carriage is mounted for lateral shifting along the carriage rod and also for rocking about the axis of the carriage rod. A portion of the carriage rides back and forth freely on the anti-rotation rail. Rocking of the carriage, which is usually produced by raising and lowering of the carriage where it overlies the anti-rotation rail, is effective to change printhead-to-media spacing. U.S. Pat. No. 6,666,537 discloses an implementation that creates such rocking of a carriage. U.S. Pat. Nos. 5,414,453; 6,616,354; and 6,672,696 disclose other implementations that involve rocking of a carriage to change the printhead-to-media spacing.

For printheads of a small swath, rocking of the carriage about the carriage rod is an acceptable and effective method of adjusting the printhead-to-media spacing. The difference in orifice-and-media spacing for a proximal orifice that defines one end of the swath of a printhead and a distal orifice that defines the other end of the swath is often small and thus negligible.

However, with printheads of larger swaths, such as a one-inch or wider swath, this difference in orifice-and-media spacing for proximal and distal orifices on a printhead may become significant and therefore may no longer be ignored if uniform print quality is to be maintained across all the orifices.

SUMMARY

According to an aspect of the present invention, there is provided a printhead-to-media spacing adjustment apparatus in a printer that includes a carriage rod fixed in position relative to a media support and a carriage for supporting at least one printhead. The carriage has a contact surface that abuts the carriage rod to allow the carriage to be supported thereon and moveable laterally along the length of the carriage rod. The apparatus further includes an actuating means that moves the carriage relative to the carriage rod along an axis transverse to a longitudinal axis of the carriage rod with the contact surface remaining in abutment with the carriage rod to thereby move the carriage relative to the media support so as to adjust the printhead-to-media spacing.

BRIEF DESCRIPTION OF DRAWINGS

The invention will be better understood with reference to the drawings, in which.

DETAILED DESCRIPTION

Generally, a printhead-to-media spacing adjustment apparatus of an image forming device according to an embodiment includes a carriage rod, a carriage for supporting at least one printhead and an actuating means. The carriage rod is fixed in position relative to a print platen or media support. The carriage has a contact surface that abuts the carriage rod to allow the carriage to be supported thereon and moveable laterally along the length of the carriage rod. The actuating means is adapted to move the carriage relative to the carriage rod along an axis transverse to a longitudinal axis of the carriage rod with the contact surface remaining in abutment with the carriage rod. In this manner, the carriage is moveable relative to the media support for adjusting the printhead-to-media spacing. Such an apparatus is able to adjust printhead-to-media spacing such that the printhead is maintained substantially parallel to the media support for each printhead-to-media spacing setting. In other words, the spacing between the orifices of the printhead and the media support is substantially even for each printhead-to-media spacing setting.

Figure 1:
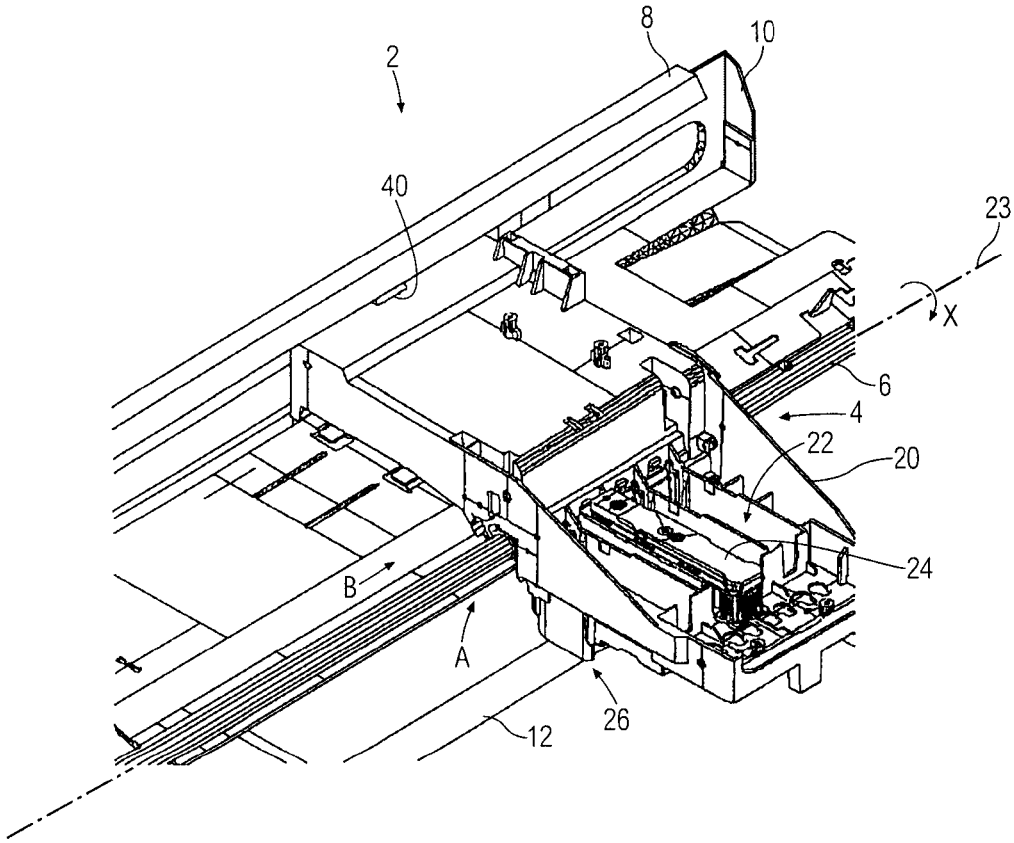
FIG. 1 is an isometric drawing of a portion of an inkjet printer showing a printhead-to-media spacing adjustment apparatus thereof according to an embodiment of the invention, the apparatus including a carriage rod, a carriage, a collar and an anti-rotation rail.

Referring to FIG. 1, an inkjet printer 2, having a printhead-to-media spacing adjustment apparatus 4 according to one embodiment of the invention is partially shown. The apparatus 4 includes a generally cylindrical carriage rod 6 and an anti-rotation rail 8 that is spaced apart from the carriage rod 6. Both the carriage rod 6 and the anti-rotation rail 8 are fixed to a frame 10 (partially shown) of the printer 2. The printer 2 also includes a media support 12 which is also fixed to the frame 10 of the printer 2. The apparatus 4 further includes a carriage 20 that is mounted on the carriage rod 6 for reversible lateral movement or shifting along the length of the carriage rod 6. The carriage 20 has four slots 22 in a front portion thereof for receiving four respective inkjet cartridges 24 (only one of which is shown). The carriage movement is effected by a motor drive and belt mechanism (not shown). The carriage 20 is rockable or rotatable about a longitudinal axis 23 of the carriage rod 6 in a direction indicated by an arrow X in FIG. 1. The anti-rotation rail 8 abuts a rear portion of the carriage 20 to prevent the rotation of the carriage 20 about the longitudinal axis 23 of the carriage rod 6 so as to maintain the carriage 20 such that the printheads (not shown) of the inkjet cartridges 24 when supported therein are at least substantially parallel to the media support 12. For some printing modes, the initial printhead-to-media spacing is set and left alone during the course of the print job. In other printing modes, the printhead-to-media spacing is controlled over the course of the print job to sustain the desired printhead-to-media spacing to cater to contours in the sheet medium surface.

Figure 2:
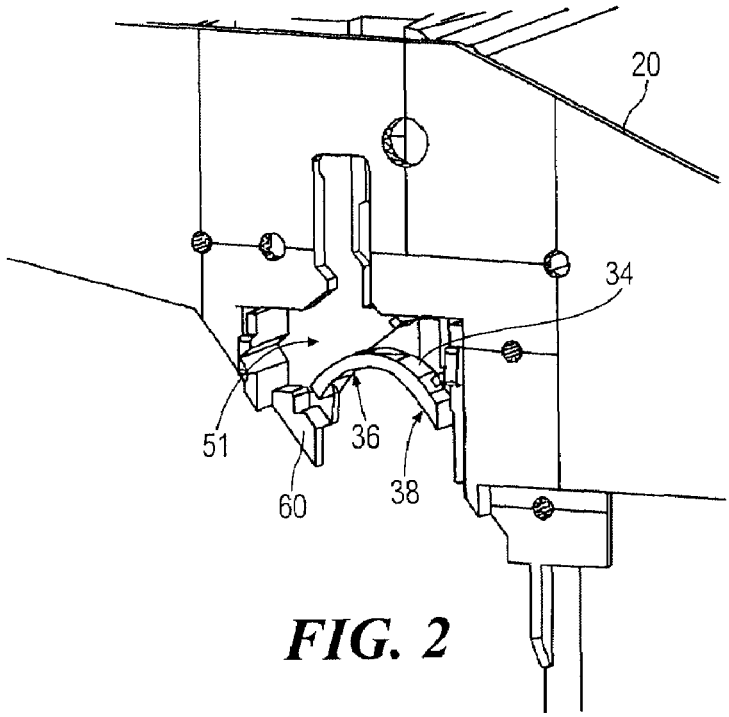
FIG. 2 is an isometric drawing of a portion of the carriage in FIG. 1 as viewed in the direction of an arrow A in FIG. 1.
Figure 3:
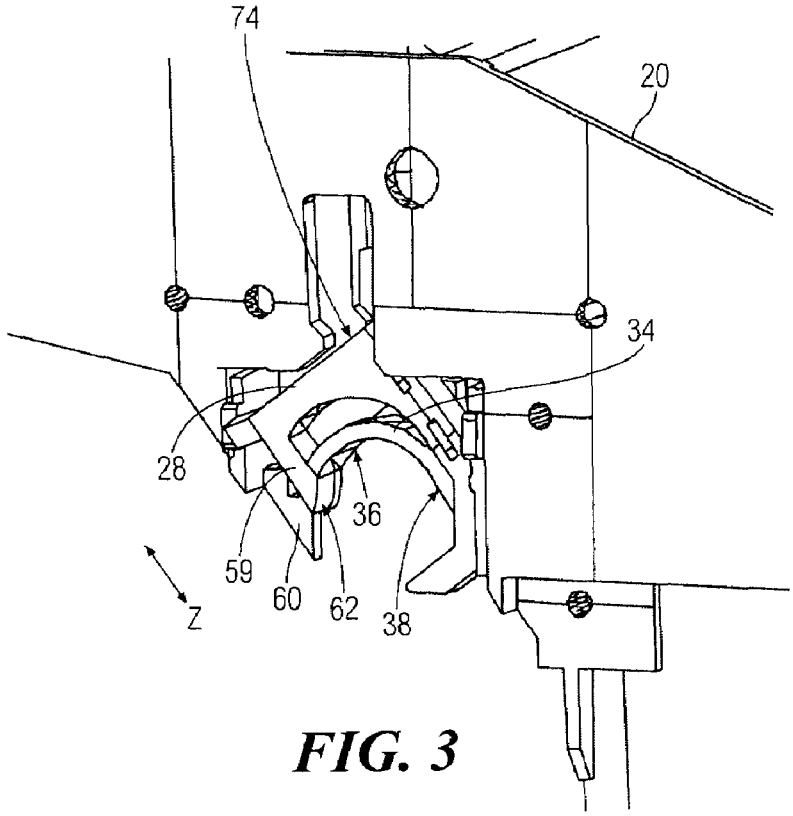
FIG. 3 is an isometric drawing similar to that in FIG. 2, further showing the collar in FIG. 1 attached to the carriage.
Figure 4A:
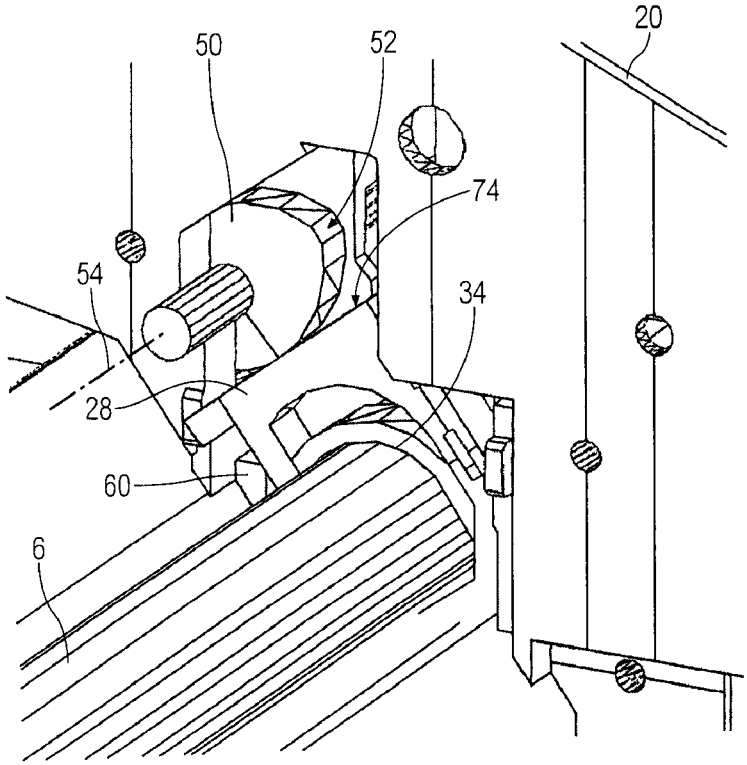
FIG. 4A is an isometric drawing similar to that in FIG. 3, further showing the carriage in FIG. 1, with the collar and a cam attached thereto, mounted on the carriage rod, wherein a wall portion of the carriage is left out to show the cam in a first position that leaves the carriage fully seated on the carriage rod so as to obtain a minimum printhead-to-media spacing.
Figure 4B:
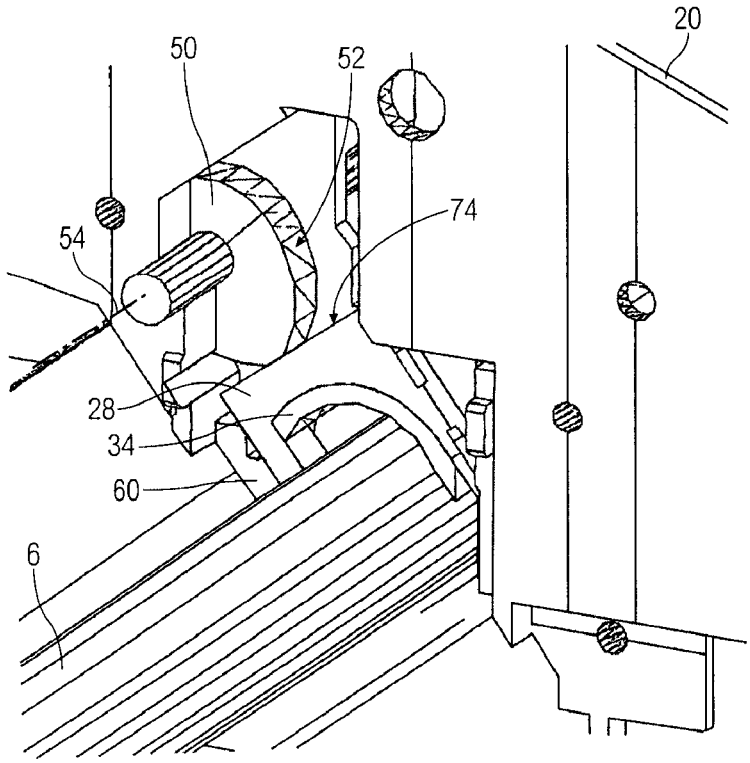
FIG. 4B is an isometric drawing similar to that in FIG. 4A, wherein the cam is shown rotated to a second position to lift the carriage off the carriage rod so as to increase the printhead-to-media spacing.

The printhead-to-media spacing adjustment apparatus 4 is described in more detail next with reference to FIGS. 2-6. As discussed above, the apparatus 4 according to one embodiment includes the cylindrical carriage rod 6, the anti-rotation rail 8 and the carriage 20. The apparatus 4 further includes a pair of collars 28 (one of which is shown in FIG. 3). The anti-rotation rail 8 is an awning-like structure stamped out of a sheet metal, such as but not limited to EG steel. The anti-rotation rail 8 includes a mounting portion 30 (FIG. 5A) and an overhanging portion 32 connected to the mounting portion 30. The undersurface of the overhanging portion 32 may include a high molecular weight polyethylene coating thereon. The coating may be conveniently applied as a strip of tape (not shown) although other means of lubricating the undersurface of the overhanging portion 32 can readily be devised by a person skilled in the art.

The carriage 20 and the collars 28 are molded from polycarbonate plastic or other suitable materials. Referring to FIG. 2, the carriage 20 includes two lateral bearings 34 (only one of which is shown in the figure) that extend from each side of a medial portion of the carriage 20. Each bearing 34 has a carriage rod contact surface that includes an arcuate surface portion 36 and an at least substantially planar surface portion 38 adjoining the arcuate surface portion 36 tangentially. The carriage 20 includes a ramp member 40 (FIG. 5A) at the rear portion thereof. The ramp member 40 has an anti-rotation rail contacting ramp surface 42 that is at least substantially parallel to the planar surface portion 38.

The apparatus 4 further includes an actuating means, such as a pair of ganged cams 50 (only one of which is shown in FIGS. 4A, 4B, 5A and 6A). Each cam 50 is pivotably mounted to the carriage 20 opposite a recess 51 at the side of the carriage 20 for receiving one of the collars 28. The cams 50 are jointly driven by a motor (not shown). The motor receives the command signal from the controller and rotate the cams accordingly. Each cam 50 has a curved circumferential surface 52 with a varying distance from a cam axis 54. As each cam 50 rotates, different portions of the curved circumferential surface 52 of that cam 50 are brought to face the corresponding recess 51. In this manner, the distance from the cam axis 54 to the portion of the cam circumferential surface 52 that faces the recess 51 changes.

During printing, a sheet medium 25 (FIG. 5A), such as a sheet of paper, an envelope or other print medium is transported appropriately through the printer 2 along a print media path (not completely shown) that includes a print zone 26 between the printheads of the inkjet cartridges 24 and the media support 12. Each printhead has a plurality of individually-controllable orifices or nozzles (not shown) through which ink in the respective ink cartridge 24 is expelled. The nozzles are arranged in at least one column. The distance between the first and the last nozzle in the column is known as the swath or swath width of the printhead or printer. The swath width may be upwards of a few millimeters, with some reaching widths of one inch or longer. Each completed movement of the carriage 20 across a medium in the print zone 26 prints what is known as a swath on the medium. After the printing of a swath, the medium is advanced by the swath width, to allow printing of a next swath on the medium.

The content of the ink in the inkjet cartridges 24 typically includes a relatively large amount of water. As the wet ink contacts a sheet medium, especially paper, the water in the ink saturates the paper fibers, causing the fibers to expand, which in turn causes the paper to buckle. Such buckling action is also referred to as cockling. Cockling of the paper tends to cause the paper to bend in an uncontrolled manner with some portions curling upward towards the printheads. Cockling thus varies the distance between the printheads and the sheet medium therebelow, which reduces print quality. In some cases, an upwardly buckling sheet may contact one or more pen nozzles causing ink to smear on the medium. In extreme cases, an upwardly buckling sheet medium may come into firm contact with one or more nozzles and in the process damaging these nozzles. The distance between the printheads and the sheet medium, or more specifically an outer ink-ejection surface of the printheads and a printing surface of the sheet medium 25, is commonly known as the pen-to-paper spacing (PPS) or printhead-to-media spacing. To ensure optimal print quality, the printhead-to-media spacing is adjusted according to the media type, more specifically the media thickness.

Figure 5A:
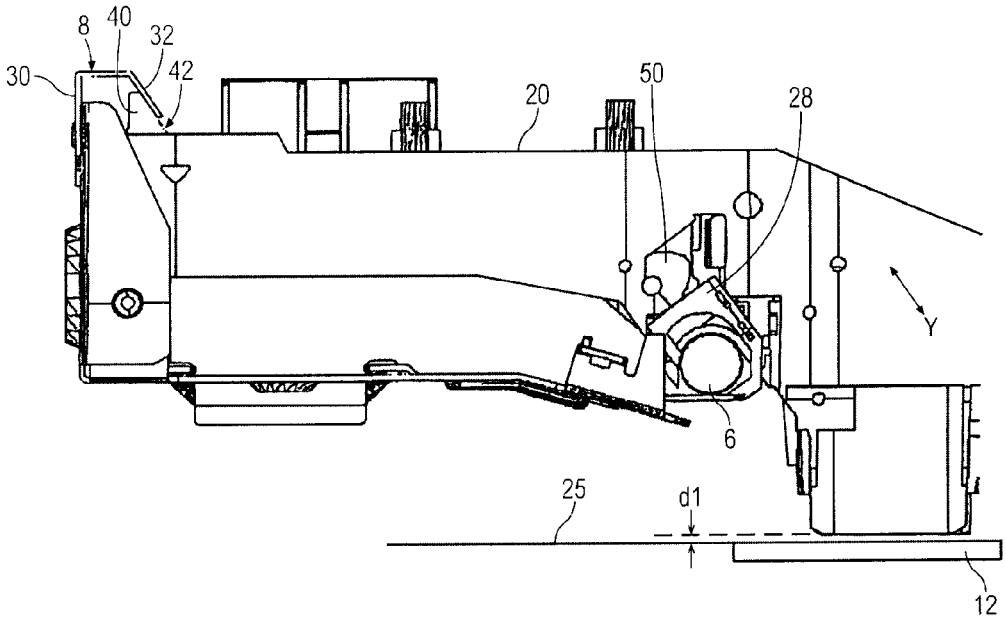
FIG. 5A is side elevation drawing of the carriage in FIG. 1, as seen in the direction of an arrow B in FIG. 1, showing the cam and the carriage in a position as shown in FIG. 4A.
Figure 6A:
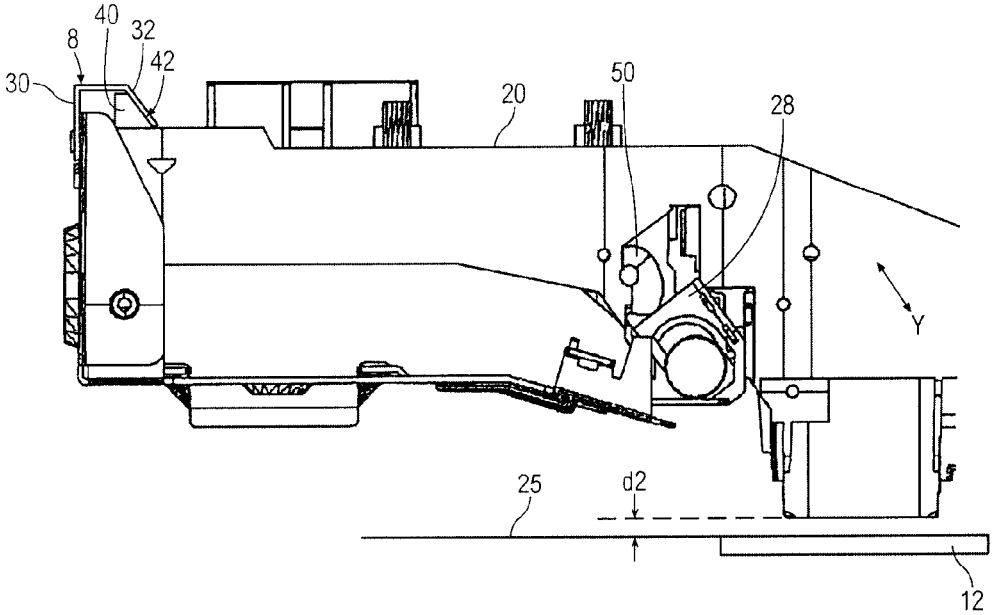
FIG. 6A is side elevation drawing similar to that in FIG. 5A, showing the cam and the carriage in a position as shown in FIG. 4B.
Figure 5B:
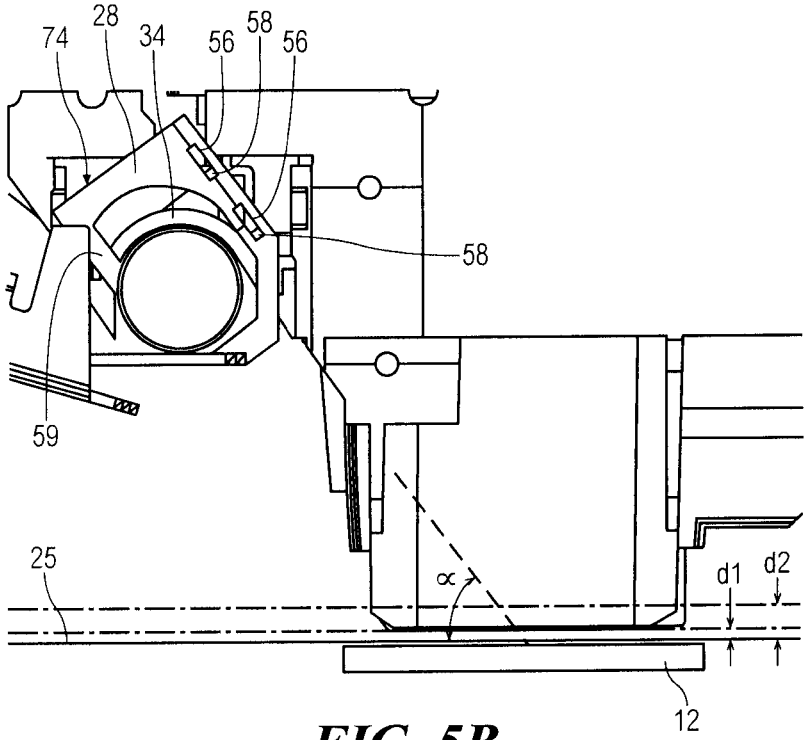
FIG. 5B is an enlarged version of a portion of FIG. 5A.
Figure 6B:
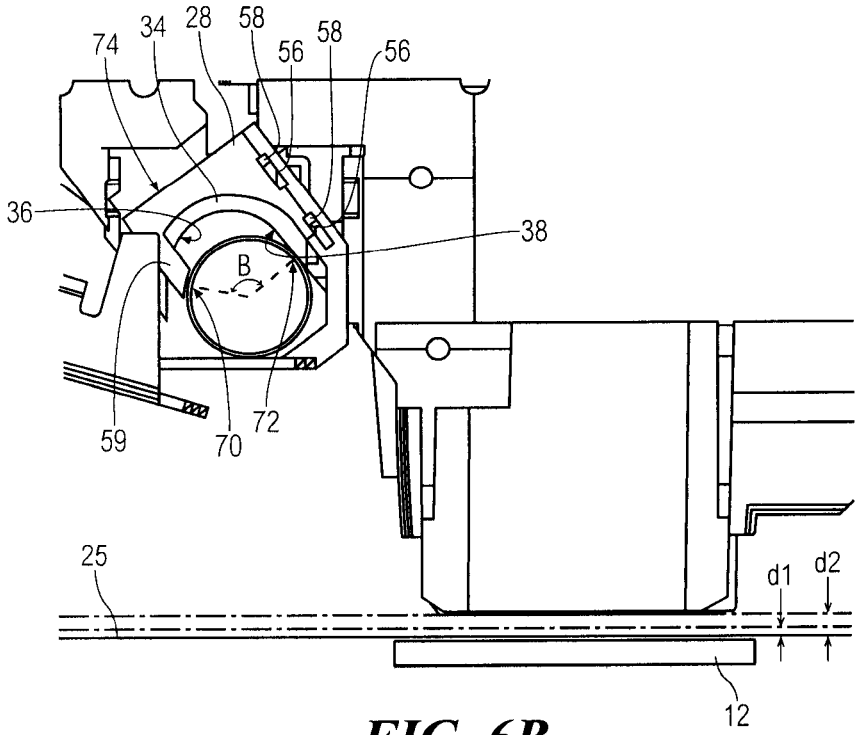
FIG. 6B is an enlarged version of a portion of FIG. 6A.

FIGS. 5A and 6A show the carriage 20 moved to a first position and a second position relative to the carriage rod 6 to attain a first and a second printhead-to-media spacing d1, d2 respectively. In the first position, the carriage 20 is completely resting or fully seated on the carriage rod 6 to define the first printhead-to-media spacing d1, which is the minimum printhead-to-media spacing d1. The capability of the carriage 20 to be moved away from or off the carriage rod 6 along a movement axis Y, transverse to the longitudinal axis 23, permits raising and lowering of the carriage 20 relative to the media support 12. It is such movement of the carriage 20 that is employed to vary the specific printhead-to-media spacing in order to accommodate different types of print media.

The printhead-to-media spacing is set for a given print job according to the media type selected for the print job. The media type is selected by the user and specified to the inkjet printer 2 through the inkjet printer driver (not shown). Specifically, the media type is included as one parameter among the print control information that is sent to the inkjet printer 2. The printer driver may include a look-up table or other data which associates an appropriate printhead-to-media spacing with the designated media type. In such a case, the printer driver receives the designated media type, converts the media type to a corresponding printhead-to-media spacing value using the look-up table and sends the printhead-to-media spacing value to the inkjet printer 2 as one parameter among the print control information.

Alternatively, the printer 2 may instead include the look-up table to determine the appropriate printhead-to-media spacing for the designated media type. In either case, the inkjet printer 2 receives a parameter from the printer driver. Based on the received parameter the printer 2, or more specifically a controller (not shown) thereof, generates a command to cause the spacing adjustment apparatus 4 to set a printhead-to-media spacing in accordance with the parameter. In some embodiments, the media type is detected by a sensor in the printer 2, and the printer 2 determines the appropriate printhead-to-media spacing for the sensed media type.

During assembly, the carriage rod 6 and the anti-rotation rail 8 are fixed to the frame 10 of the printer 2, spaced apart from each other. The carriage 20 is mounted to the carriage rod 6 with the arcuate surface portion 36 of the bearings 34 fully in contact with the carriage rod 6 to be seated thereon and with the ramp surface 42 abutting the undersurface of the overhanging portion 32 of the anti-rotation rail 8. The cams 50 are pivotably mounted to the carriage 20 and rotated to be clear of the recesses 51. The collars 28 are then slipped onto the carriage rod 6 on either side of the carriage 20 and slid along the carriage rod 6 into the recesses 51 of the carriage 20 to be attached thereto. When attached to the carriage 20, the two rectangular slots 56 of each collar 28 receive two corresponding guide pins 58 that extend from a wall of the carriage 20.

A leg 59 of each collar 28 is received in a gap between an end of the corresponding bearing 34 and a corresponding retainer guide 60 to be moveable therebetween. The collars 28 when attached to the carriage 20 are moveable along the length of the carriage rod 6 together with the carriage 20. When mounted in this manner, each collar 28 surrounds its corresponding bearing 34 and has a carriage rod contacting surface 62 (FIG. 3) that is adjacent the arcuate surface portion 36 of the bearing 34. The carriage 20 is also moveable relative to the collar 28 in a direction of a double-ended arrow Z in FIG. 3, as guided by the gaps between the bearings 34 and retainer guides 60, and guide pins 58.

When mounted on the cylindrical carriage rod 6 in the first position, the printheads are held at least substantially parallel to and at a first distance from the media support 12 corresponding to the printhead-to-media spacing d1. Also, in this position, a plane of the planar contact surface 38 of the carriage 20 forms an oblique angle $\alpha$ (FIG. 5B) with a plane of the media support 12. This oblique angle $\alpha$ may be in the range of between 5° and 85°, and is shown in the figures to be about 45°.

With such an arrangement, the carriage rod contacting surface 62 of the collar 28 is in contact with a first portion 70 (FIG. 6B) of the carriage rod 6 and the planar surface portion 38 of the carriage 20 is in contact with a second portion 72 of the carriage rod 6. The first and second portions 70, 72 of the carriage rod 6 are on opposite sides of a vertical axis through the cross-section of the carriage rod 6. The two portions 70, 72 of the carriage rod 6 subtend an angle $\beta$ of between 90° and 170° at the centre of the circular cross-section of the carriage rod 6. In other words, the collar 28 cooperates with the planar surface portion 38 to define a V-bearing that is in abutment with the carriage rod 6. As only the planar surface portion 38 of the carriage 20 moves relative to the carriage rod 6, the carriage 20 is still substantially firmly seated on the carriage rod 6 when the carriage 20 is moved away from carriage rod 6 since the carriage 20 remains in contact with the carriage rod 6 at four different points 70, 72. The abutment of the ramp surface 42 of the carriage 20 with undersurface of the anti-rotation rail 8 defines a fifth point of contact between the carriage 20 and other fixed components of the printer 2. In some embodiments, the apparatus 4 may include a carriage preloader (not shown), such as a cantilevered leaf spring that spans the length the carriage rod 6, which biases the carriage 20 toward the carriage rod 6. This carriage preloader ensures that the carriage 20 remains in contact with the carriage rod 6 at the five contact points 70, 72 during the movement of the carriage 20 along the length of the carriage rod 6.

During use, the cams 50 are synchronously rotated so that their respective curved circumferential surface 52 comes into contact with an abutment surface 74 of the corresponding collar 28, orthogonal to the leg 59 of that collar 28, to push the carriage 20 away from the collar 28 so as to move the carriage 20 relative to the carriage rod 6, more specifically move the carriage away from or off the carriage rod 6. The carriage 20 instead of being supported on the carriage rod 6 at the arcuate surface portion 36 begins to be dragged up the carriage rod 6 with the planar surface portion 38 in contact with the carriage rod 6 as described above. Thus, the carriage 20 remains to be supported on the carriage rod 6 with the planar surface portions 38 that form the V-bearings abutting the carriage rod 6.

In this manner, the distance between the printheads and the media support 12 is varied to correspond to the desired printhead-to-media spacings d1, d2. The cams 50 are rotated to lift the carriage 20 off the carriage rod 6 and to lower the carriage 20 back towards the carriage rod 6 along the movement axis Y to increase and decrease the printhead-to-media spacing respectively.

Any desired printhead-to-media spacing between the minimum spacing and a maximum spacing may be attained by rotating the cams 50 until a corresponding point on the cams 50 abuts the abutment surface 74 of the collars 28. The cams 50 are held at that position until the printhead-to-media spacing needs to be further adjusted. In one embodiment the cams 50 may be rotated to correspond to three alternative printhead-to-media spacings. For example, one small printhead-to-media spacing may be used for non-cockling media, another medium spacing for cockling media and a large spacing for envelopes and cardstock. As another example, a small printhead-to-media spacing may be used for single-side printing on plain paper, a medium spacing for doubled sided printing on the plain paper and a large spacing for envelops and cardstock.

Figure 10:
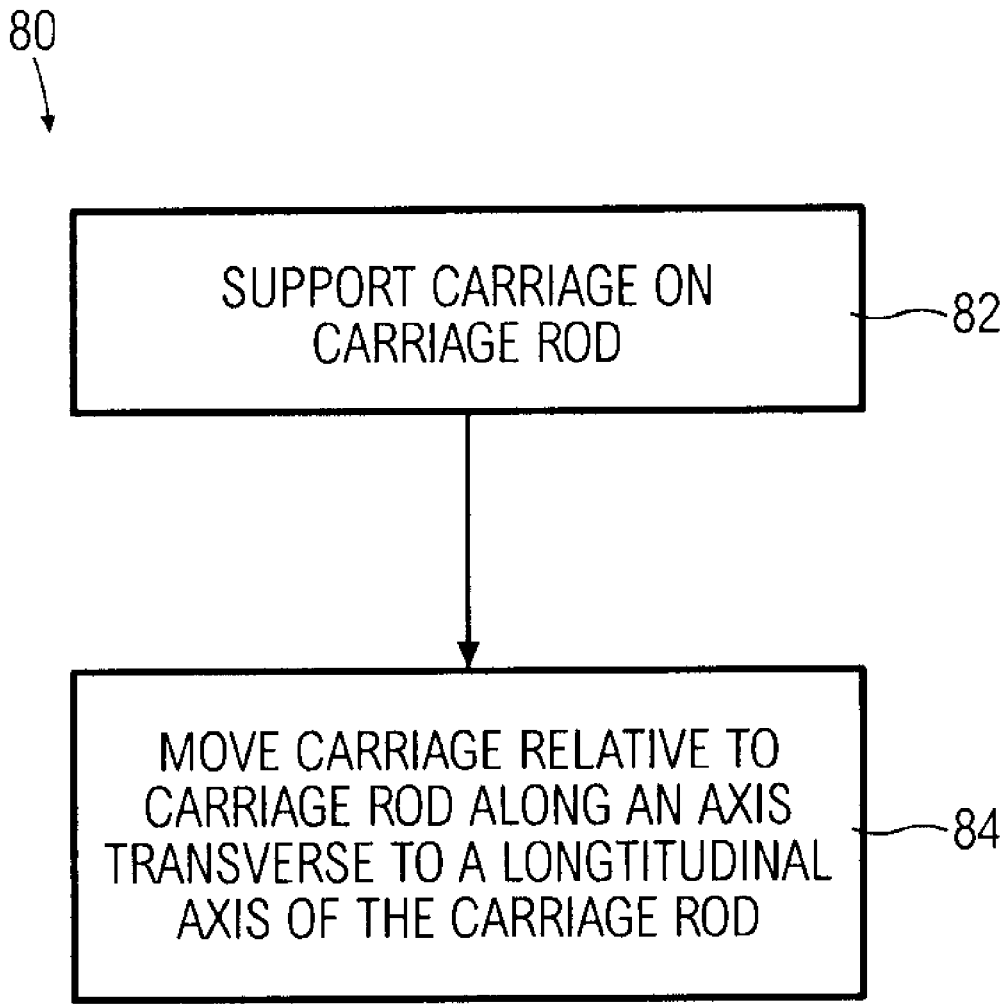
FIG. 10 is a flowchart of a sequence of steps for adjusting the printhead-to-media spacing in the inkjet printer in FIG. 1.

Accordingly, the apparatus 4 implements a method 80 (FIG. 10) for adjusting a printhead-to-media spacing in the printer 2. The method includes supporting 82 the carriage 20 on the carriage rod 6 to allow the carriage 20 to be moveable laterally along the length of the carriage rod 6, and moving 84 the carriage 20 relative to the carriage rod 6 along an axis Y transverse to a longitudinal axis 23 of the carriage rod 6 to thereby move the carriage 20 relative to the media support 12 so as to adjust the printhead-to-media spacing. The carriage 20 is moved along the axis Y by moving the carriage

20 away from or off the carriage rod 6. The carriage 20 may be supported on the carriage rod 6 with a contact surface 38 of the carriage 20 abutting the carriage rod 6 and the carriage 20 may be moved relative to the carriage rod 6 along the axis Y with the contact surface 38 remaining in abutment with the carriage rod 6. In some embodiments, the method may further include biasing the carriage 20 toward the carriage rod 6.

Advantageously, the apparatus that embodies the invention is able to adjust and maintain the printhead-to-media spacing such that the spacing is at least substantially uniform throughout the swath of a printhead for each spacing setting. In other words, the printhead may be maintained at least substantially parallel to the media support regardless of the spacing setting. Moreover, complicated models that were required in the prior art to account for dot placement accuracy and flight trajectory error due to the spacing differential between the first and last nozzle in a swath of a printhead is not required for the apparatus. It is unlikely that the overall size of a printer with such an apparatus for adjusting the printhead-to-media spacing to several different values would be impacted in any dimension. The design of the apparatus also allows relatively easy incorporation of a carriage preloader in the printer.

Figure 7:
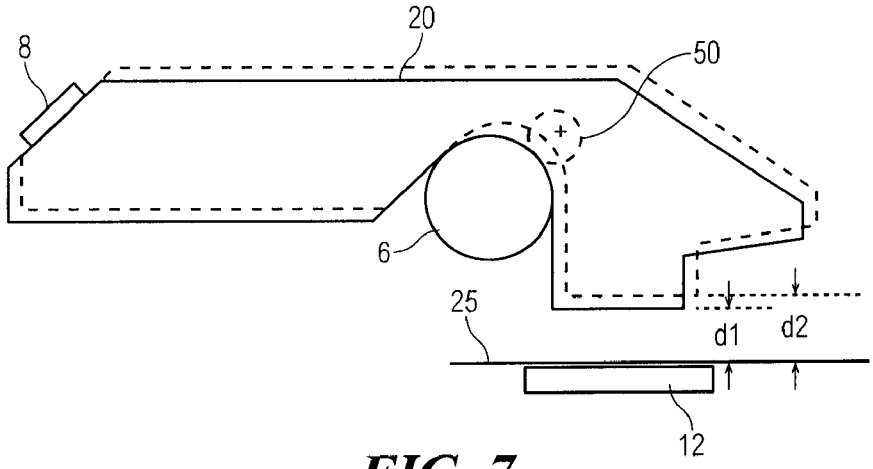
FIG. 7 is a printhead-to-media spacing adjustment apparatus according to another embodiment of the invention, wherein a cam is rotated to come into direct contact with a carriage rod to lift a carriage, to which the cam is pivoted, off the carriage rod.

Although the present invention is described as implemented in the above-described embodiment, it is not to be construed to be limited as such. For example, the cams 50 may be rotatable to come into direct contact with the carriage rod 6 to move the carriage 20 relative to the carriage rod 6 as shown in FIG. 7.

As another example, a single cam 50 that is centrally disposed on the carriage 20 may be used to abut the carriage rod 6 directly or a single collar 28 to move the carriage 20 relative to the carriage rod 6.

Figure 8:
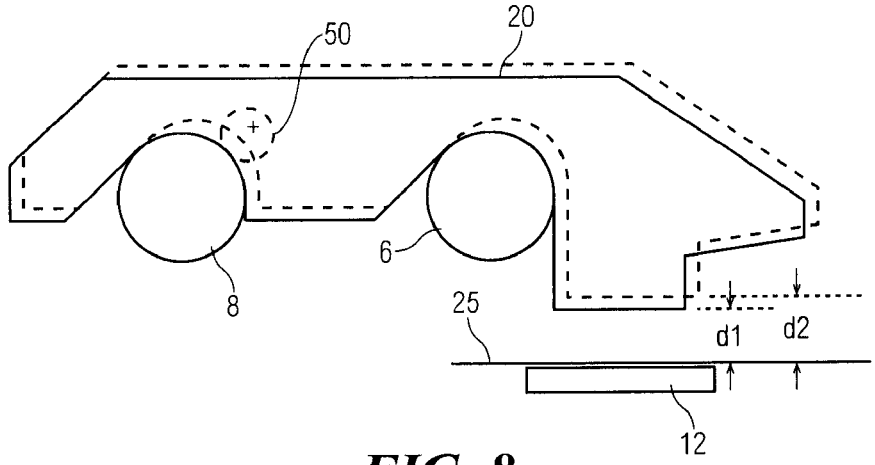
FIG. 8 is a printhead-to-media spacing adjustment apparatus according to yet another embodiment of the invention, wherein a cam is rotated to come into direct contact with an anti-rotation rail to lift a carriage, to which the cam is pivoted, off a carriage rod.

As a further example, the carriage 20 may be supported on both the carriage rod 6 and the anti-rotation rail 8 as shown in FIG. 8. In such a case, the cam 50 may be rotatable to come into direct contact, as shown in FIG. 8 or via a collar 28, with the anti-rotation rail 8 for moving the carriage 20 relative to the carriage rod 6.

Figure 9:
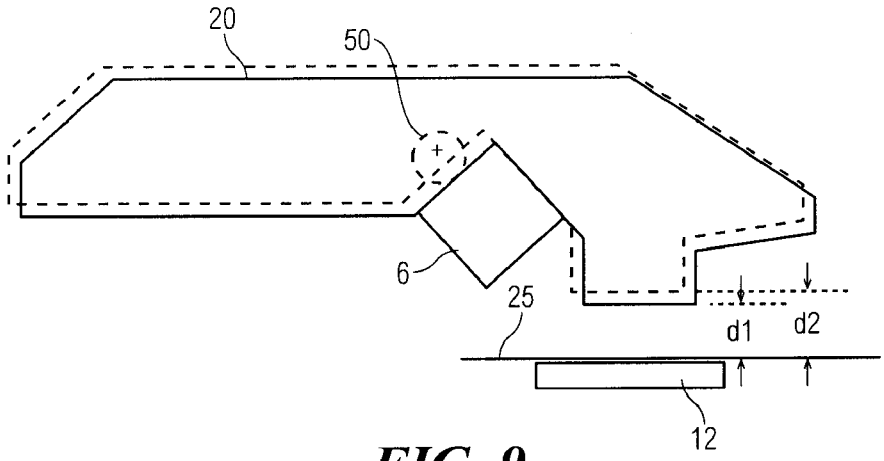
FIG. 9 is a printhead-to-media spacing adjustment apparatus according to yet another embodiment of the invention, wherein a carriage is supported on a carriage rod of a square cross-section.

As yet a further example, the carriage rod 6 may be of a polygonal cross section, for example a square cross section as shown in FIG. 9. In such a case, if the carriage 20 is balanced, an anti-rotation rail is unlikely to be necessary.

Other actuating means may also be employed in place of the cam 50 to move the carriage 20 relative to the carriage rod 6 along the movement axis Y in FIG. 5A. As an example, a bolt may be inserted through a threaded hole in a plate (all not shown) fixed to the carriage 20. The bolt may be oriented with its longitudinal axis along the movement axis Y. A free end of the bolt abuts either the collar 28 or the carriage rod 6. The bolt is turned in one direction to raise, and in the other direction, to lower the carriage. As another example, an actuating means may be one (not shown) that is fixed to the carriage 20 and has a ramped surface. This actuating means is moveable along an axis such that interruption of movement of its ramped surface is translated to movement of the carriage 20 along the movement axis Y. As a further example, the collar 28 may include a rack (not shown) extending in the direction of the movement axis Y and the carriage 20 may include a corresponding pinion (not shown) fixed thereto. The rack and pinion are arranged such that teeth on the rack engage those on the pinion. The pinion may either be driven directly using a motor or via a gear train. The circular movement of the pinion is translated to linear movement of the carriage 20 along the movement axis Y.

The embodiments described above relates to "on-axis" printing systems where the main ink supply is stored locally within replaceable inkjet cartridges mounted on a moving carriage. However, the invention is equally applicable to "off-axis" printing systems wherein the main ink supply is stored at a stationary location in the printer that is remote from the printing zone.

What is claimed is:

1. A printer comprising:

a media support having a media support surface;

a carriage rod having a longitudinal axis;

a carriage holding at least one printhead at a distance from the media support surface, said carriage being supported on the carriage rod and moveable laterally along the longitudinal axis of the carriage rod, said carriage comprising a carriage rod contact surface, which includes a planar portion and an arcuate portion, said planar portion lies in a plane that forms an obligue angle relative to the media support surface and said arcuate portion is in contact with the carriage rod when the printhead is at a first distance from the media support surface;

an actuating means mounted to the carriage, said actuating means comprising a cam, which is rotatable about a cam axis and has a curved circumferential surface that varies in distance from the cam axis; and an anti-rotation rail in sliding contact with a rear portion of the carriage and being positioned so as to prevent to the carriage from rotating about the carriage rod, wherein said cam is rotatable to come into contact with the carriage rod so as to cause the arcuate portion of the carriage rod contact surface to move away from the carriage rod in a direction that is obligue relative to the media support surface while maintaining contact between the planar portion and the carriage rod, thereby causing the rear portion of the carriage to shift upwards relative to the anti-rotation rail and causing the printhead to move from said first distance to a second distance while maintaining the printhead substantially parallel to the media support surface.

* * * * *

UNITED STATES PATENT AND TRADEMARK OFFICE

CERTIFICATE OF CORRECTION

PATENT NO. : 7,303,246 B2
APPLICATION NO. : 11/016301
DATED : December 4, 2007
INVENTOR(S) : Kale Mark Buonerba and Wai Yuen Ho It is certified that error appears in the above-identified patent and that said Letters Patent is hereby corrected as shown below:

Drawings: Sheet 7 of 7, “Longtitudinal axis” should be “Longitudinal axis”.

Column 8, line 40, “prevent to” should be “prevent”.

Signed and Sealed this

Twenty-fifth Day of November, 2008

JON W. DUDAS
*Director of the United States Patent and Trademark Office*